US007749002B1

(12) United States Patent
Chiang

(10) Patent No.: US 7,749,002 B1
(45) Date of Patent: Jul. 6, 2010

(54) WATER-PROOF CONNECTOR

(75) Inventor: Shu-Man Chiang, Taipei (TW)

(73) Assignee: Cheng Uei Precision Industry Co., Ltd., Taipei (TW)

( * ) Notice: Subject to any disclaimer, the term of this patent is extended or adjusted under 35 U.S.C. 154(b) by 0 days.

(21) Appl. No.: 12/554,942

(22) Filed: Sep. 7, 2009

(51) Int. Cl.
*H01R 13/44* (2006.01)

(52) U.S. Cl. ..... 439/135

(58) Field of Classification Search ..... 439/701, 439/135, 278, 283
See application file for complete search history.

(56) References Cited

U.S. PATENT DOCUMENTS 3,936,124 A * 2/1976 Tuttle et al. ..... 439/279
4,556,226 A * 12/1985 Ito ..... 439/273
7,422,458 B2 * 9/2008 Arai ..... 439/274

* cited by examiner

*Primary Examiner*—Javaid Nasri

(57) ABSTRACT

A water-proof connector has a base. The base has a passageway passing through a first end thereof and a second end thereof opposite to the first end. The second end has a first stopping rib and a second stopping rib protruded outwards from two opposite portions of an edge of the passageway. Two ends of each of the first and second stopping ribs are extended oppositely to form a third stopping rib and a fourth stopping rib. A cap covered to the second end has a covering plate. The covering plate has an indention area at an engaging side thereof. A side of the indention area encloses and abuts against the first stopping rib and the second stopping rib, and has two opposite portions formed with two spaced open first slots and two spaced open second slots, respectively, for receiving the third stopping ribs and the fourth stopping ribs.

9 Claims, 6 Drawing Sheets

WATER-PROOF CONNECTOR

BACKGROUND OF THE INVENTION

1. Field of the Invention

The present invention relates to a water-proof connector, and particularly to a water-proof connector having a water-proof structure.

2. The Related Art

Conventionally, an audio socket connector mounted to an audio electronic device for transmitting electrical signals has an insulating housing and a plurality of terminals. The insulating housing has a passageway for receiving an audio terminal of a mating audio plug. The terminals are mounted to the insulating housing and partly inserted into the passageway for electrically connecting with the inserted audio terminal of the audio plug. In order to prevent the water from flowing into the audio electronic device through the passageway, a cap is provided to cover an end of the passageway inside the audio electronic device, functioning as water resistance. However, since the engagement interface between the cap and the insulating housing is generally a plane, the water is able to permeate the inside of the audio electronic device through interstices between the cap and the insulating housing. Therefore, it is desirable and necessary to design a cap which is capable of sealing the inner end of the passageway, preventing the water from flowing into the audio electronic device.

SUMMARY OF THE INVENTION

Accordingly, an object of the present invention is to provide a water-proof connector having a water-proof structure. The water-proof connector has an insulating housing having a base. The base has a passageway passing through a first end thereof from which the mating plug is inserted into the passageway and a second end thereof opposite to the first end. The second end has a first stopping rib and a second stopping rib protruded outwards from an upper portion and a lower portion of an edge of the passageway. The first stopping rib is spaced from the second stopping rib. Two free ends of each of the first and second stopping ribs are extended opposite to each other to form a third stopping rib and a fourth stopping rib. A cap covered to the second end of the insulating housing has a covering plate. The covering plate has an indention area at an engaging side thereof. A side of the indention area which encloses and abuts against the first stopping rib and the second stopping rib, has two opposite portions formed with two spaced open first slots and two spaced open second slots, respectively, for engaging with the third stopping ribs and the fourth stopping ribs.

As described above, when the cap is coupled with the insulating housing, the third stopping ribs and the fourth stopping ribs are inserted into the corresponding the first and second slots. The first and second stopping ribs abut against the side of the indention area. Such engagement in form with protrusion and recess is tight and reliable to seal the inner end of the passageway, preventing the water from permeating an electronic device where the water-proof connector is mounted, through the passageway.

BRIEF DESCRIPTION OF THE DRAWINGS

The present invention will be apparent to those skilled in the art by reading the following description thereof, with reference to the attached drawings, in which.

DETAILED DESCRIPTION OF THE PREFERRED EMBODIMENT

Figure 1:
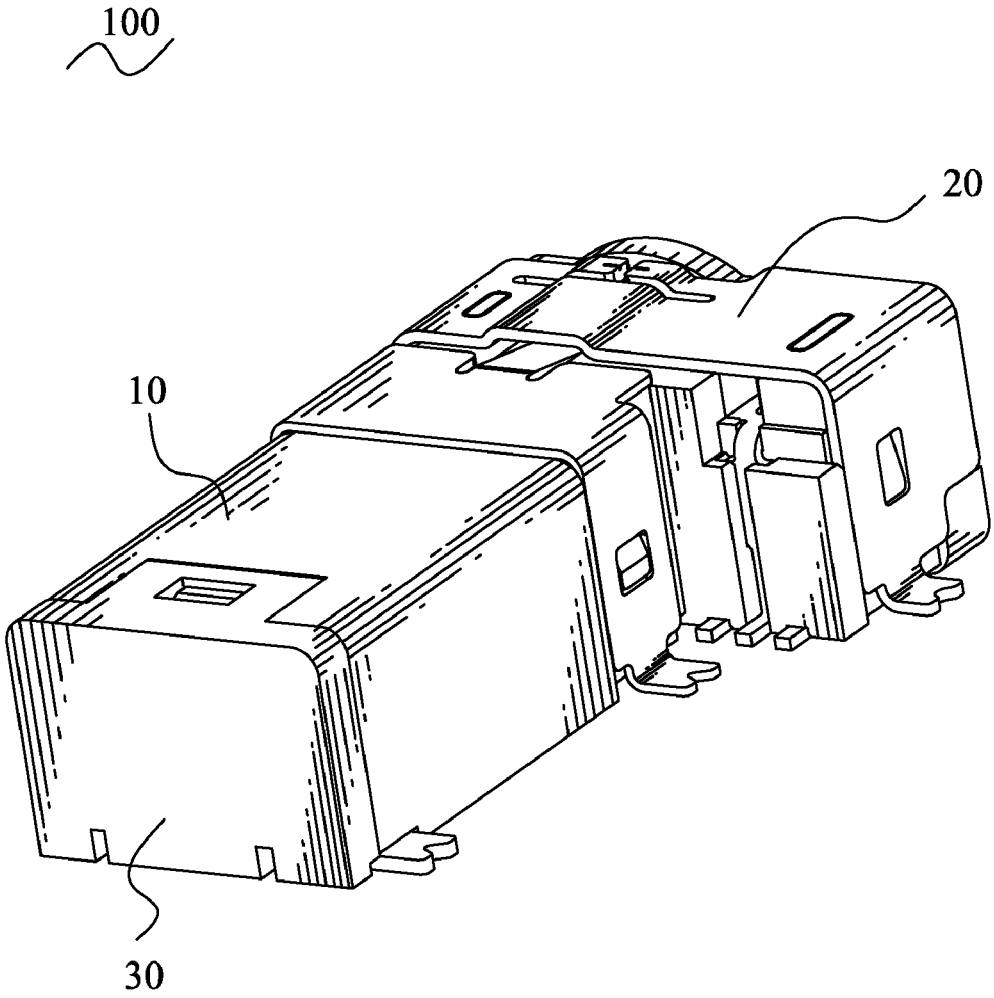
FIG. 1 is an assembled, perspective view of a water-proof connector of an embodiment in accordance with the present invention.
Figure 2:
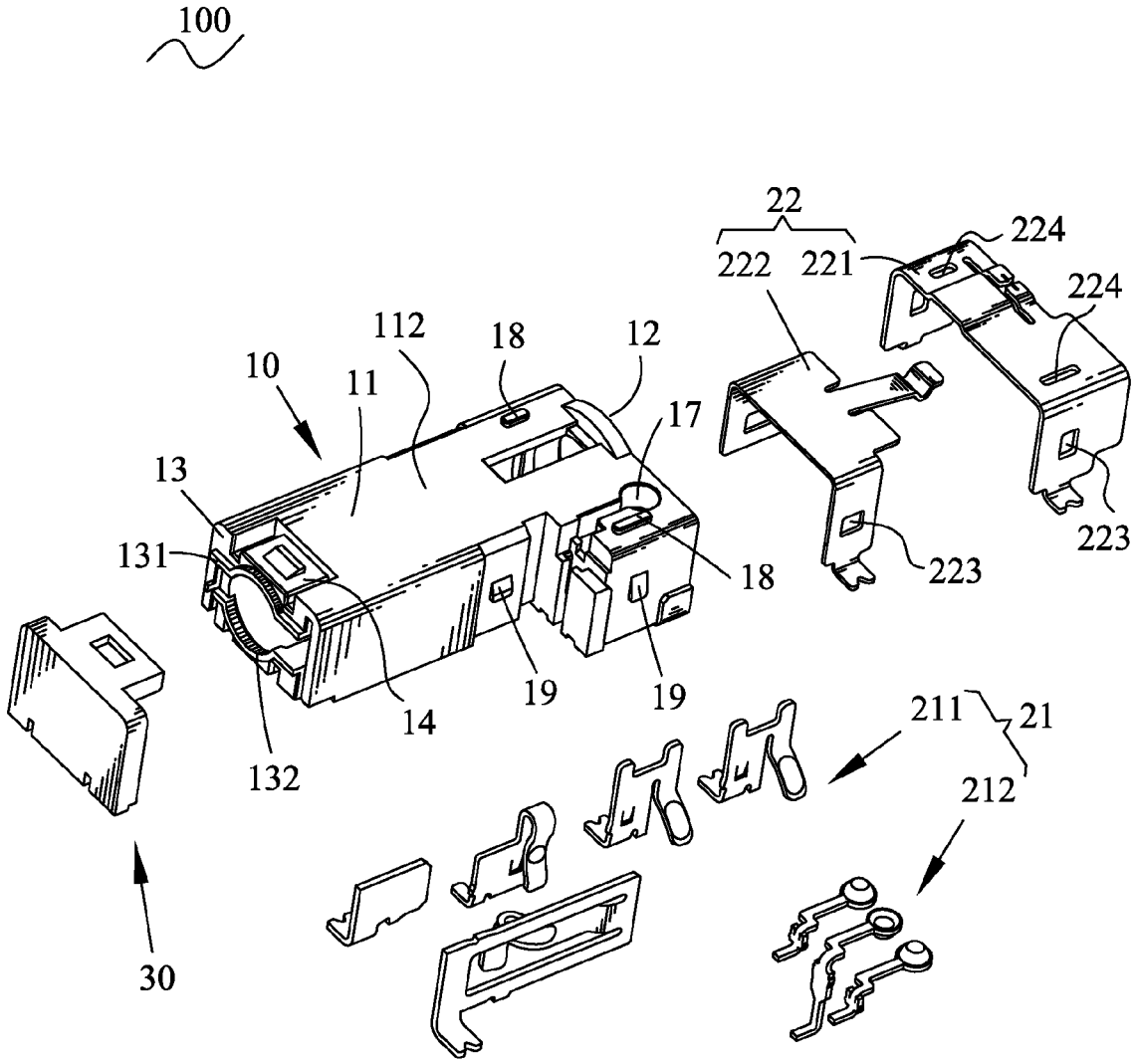
FIG. 2 is an exploded, perspective view of the water-proof connector shown in FIG. 1.

Referring to the drawings in greater detail, and first to FIGS. 1-2, the embodiment of the invention is embodied in a water-proof connector 100. The water-proof connector 100 comprises an insulating housing 10, a plurality of terminals 20 mounted to the insulating housing 10, and a cap 30 coupled with the insulating housing 10.

Figure 3:
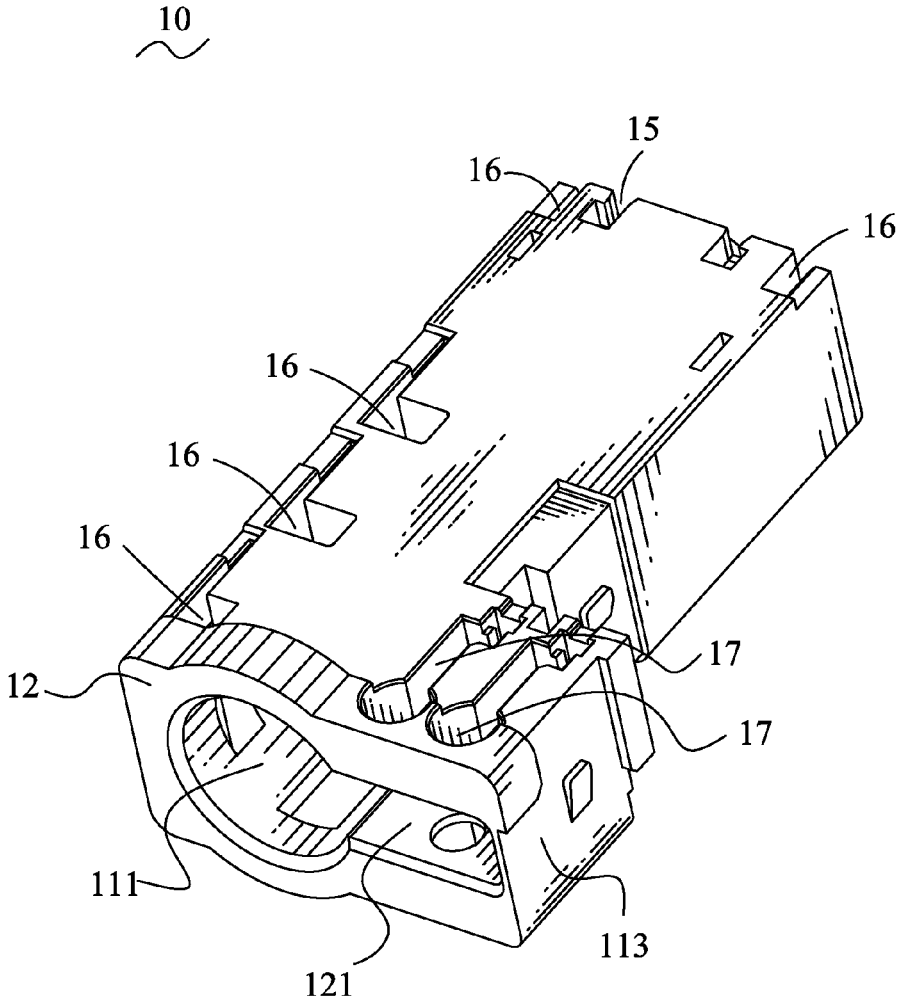
FIG. 3 is a perspective view of an insulating housing of the water-proof connector shown in FIG. 2.
Figure 4:
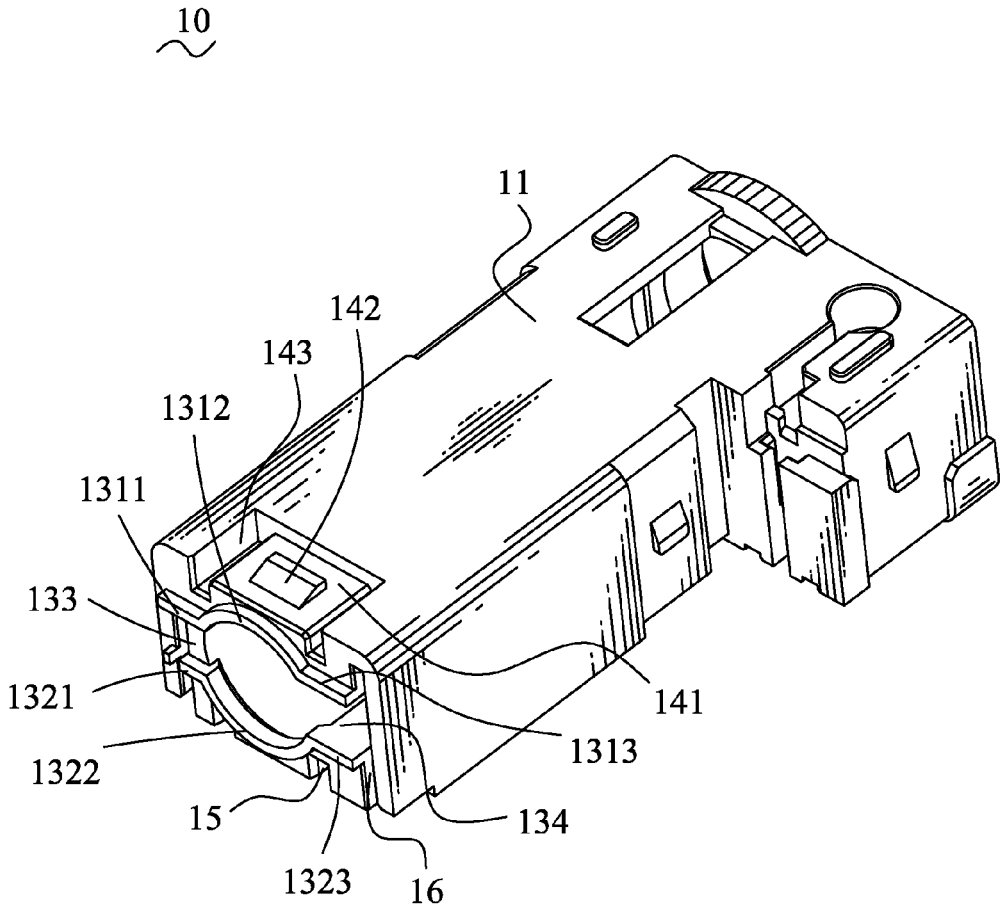
FIG. 4 is a perspective view of the insulating housing of the water-proof connector shown in FIG. 3 seen from another angle.

With reference to FIGS. 2-4, the insulating housing 10 has a substantially rectangular base 11. The base 11 defines a first end 12, a second end 13 opposite to the first end 12, and a top surface 112 connecting with the first end 12 and the second end 13. A passageway 111, with a circular cross-section, is formed in the base 11 and passes through middle portions of the first end 12 and the second end 13 for receiving an audio terminal of a mating audio plug (not shown). The first end 12 has a receiving recess 121 which is disposed at a side of the passageway 111 and communicates with the passageway 111. In this embodiment, an end of a side of the base 11 adjacent to the first end 12 is extended laterally to form a protrusion 113. The receiving recess 121 is recessed in the protrusion 113, with an opening formed at an end thereof which is flush with the first end 12. A top and a bottom of the protrusion 113 are formed with a plurality of second grooves 17 extending substantially perpendicular to the first end 12 for receiving charging terminals 212 of the terminals 20. The second end 13 has an upper rib 131 and a lower rib 132, facing each other. The upper rib 131 has an arc first stopping rib 1312 protruded outwards and inwards from an upper portion of an edge of the passageway 111, and a third stopping rib 1311 and a fourth stopping rib 1313 extended opposite to each other from two free ends of the first stopping rib 1312. The lower rib 132 is substantially analogue to the upper rib 131 and has an arc second stopping rib 1322 at a lower portion of the edge of the passageway 111 and spaced away from the first stopping rib 1312, a third stopping rib 1321 and a fourth stopping rib 1323 extended opposite to each other from two free ends of the second stopping rib 1322. In this embodiment, the third stopping ribs 1311, 1321 and the fourth stopping ribs 1313, 1323 are substantially parallel to the top surface 112 of the base 11. The third stopping ribs 1311, 1321 face each other and form a chamber 133 therebetween. An area between the fourth stopping ribs 1313, 1323 is formed with a receiving trough 134, communicating with the passageway 111. The receiving trough 134 extends opposite to the passageway 111 to form a first groove 16 for receiving one of audio terminals 211 of the terminals 20. Herein, the first groove 16 extends upwards and downwards and passes through a bottom of the base 11. Two hooking grooves 15 are extended inwards and bent opposite to each other from a lower portion of the second end 13. The hooking grooves 15 pass through the bottom of the base 11 and are spaced away from each other.

The top surface 112 of the base 11 has a rectangular buckling recess 14. The buckling recess 14 passes through the second end 13. A middle of a bottom 141 of the buckling recess 14 is protruded upwards to form a buckling lump 142, having an inclining surface adjacent to the second end 13. Two sides of the bottom 141 of the buckling recess 14 have grooves 143. Each of the grooves 143 passes through the second end 13 and reaches two contiguous sides of the buckling recess 14. The top surface 112 of the base 11 has two fixing lumps 18. The fixing lumps 18 are arranged side by side and adjacent to the first end 12. The bottom of the base 11 is recessed with a plurality of first grooves 16 at intervals, adjacent to a side of the base 11 opposite to the protrusion 113, for receiving other audio terminals 211. In this embodiment, one of the first grooves 16 adjacent to the second end 13 passes through the second end 13 and the third stopping rib 1321. Each of two opposite sides of the base 11 has two jamming lumps 19, adjacent to the first end 12, for fixing a set of switch terminals 22.

The terminals 20 is composed of a set of transmitting terminals 21 and one set of switch terminals 22. The transmitting terminals 21 have a plurality of audio terminals 211 and a plurality of charging terminals 212. The audio terminals 211 are inserted into the first grooves 16. The charging terminals 212 are mounted to the second grooves 17. The switch terminals 22 has an elastic terminal 221 and a fixing terminal 222, each of which may be bent with a metal plate to show a substantial door-frame shape. The elastic terminal 221 and the fixing terminal 222 both have mating openings 223 at lateral plates thereof for engaging with the corresponding jamming lumps 19 for fixing the elastic terminal 221 and the fixing terminal 222 to the insulating housing 10. A top plate of the elastic terminal 221 has two fixing openings 224 coupled with the fixing lumps 18 for positioning the elastic terminal 221.

Figure 5:
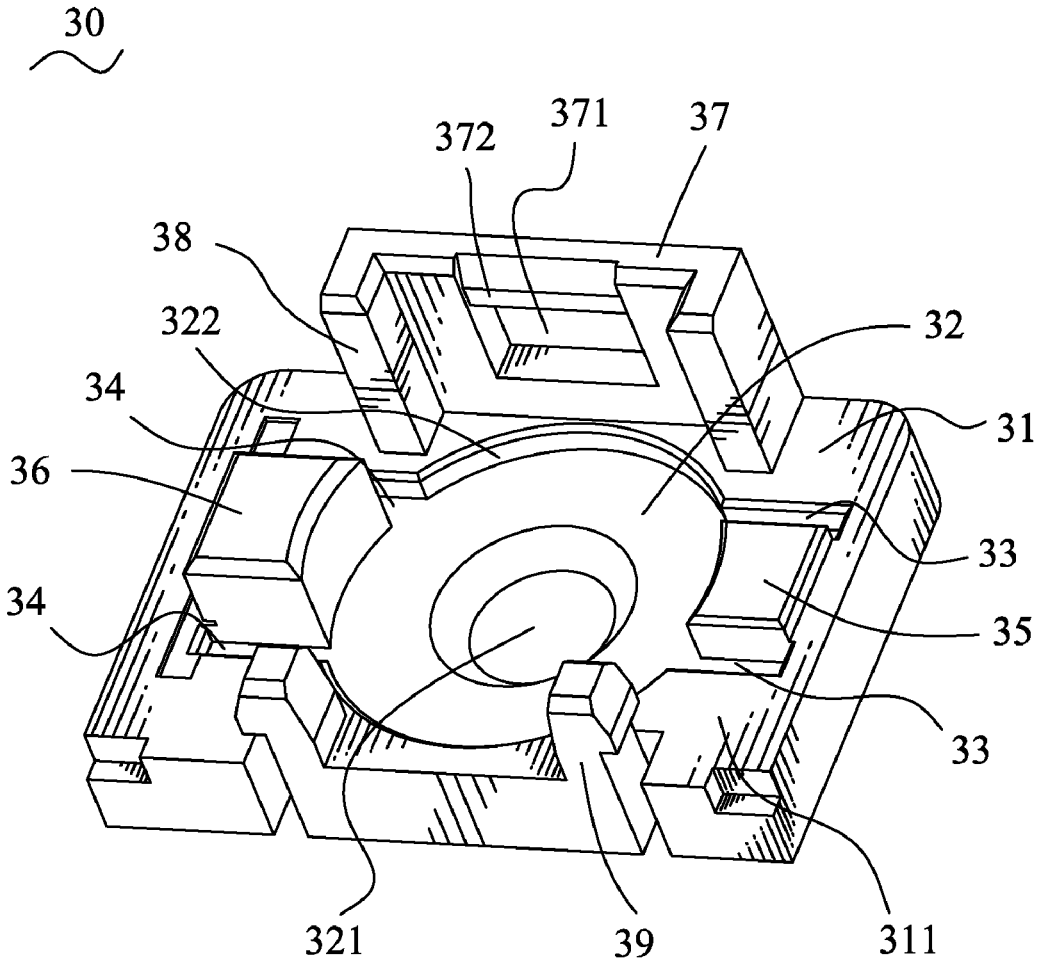
FIG. 5 is a perspective view of a cap of the water-proof connector shown in FIG. 2 seen from another angle.
Figure 6:
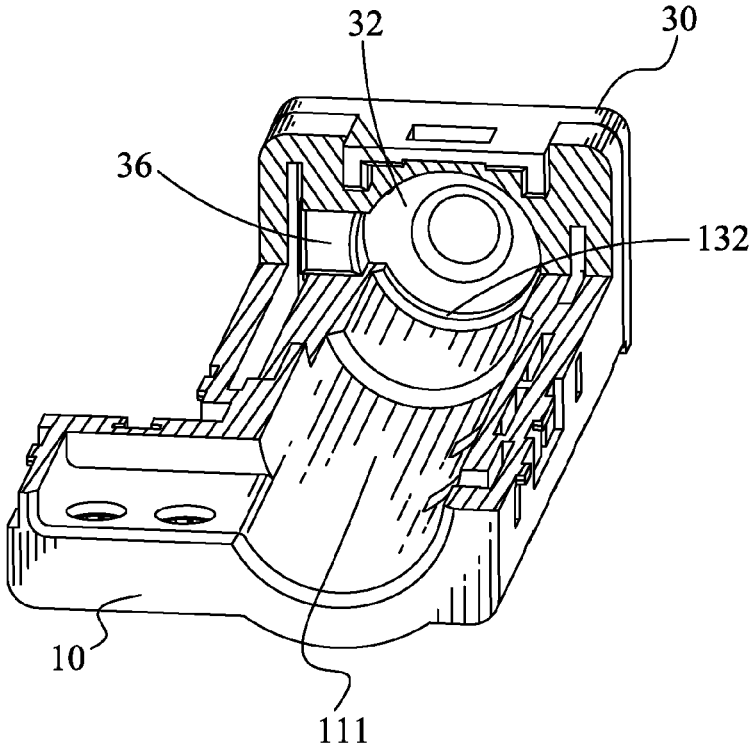
FIG. 6 is a cut-away perspective view illustrating an engagement between the insulating housing and the cap shown in FIG. 1.

Please refer to FIG. 2 and FIGS. 5-6, the cap 30 has a covering plate 31, with a circular indention area 32 formed at a middle of an engaging side 311 thereof. Herein, a center of the indention area 32 is concaved inwards to form a recess 321 at a center thereof for receiving a free end of the inserted audio terminal of the mating plug. An upper portion of the engaging side 311 of the covering plate 31 is extended perpendicularly and outwardly to form a rectangular buckling slice 37, and two inserting slices 38 perpendicularly depending from two opposite sides of the buckling slice 37, around the indention area 32. The buckling slice 37 has a rectangular trough 371 at a bottom thereof, with a side wall 372 away from the covering plate 31 having an inclining surface facing outwards. In assembly, the buckling lump 142 slides across the side wall 372 and buckles with the trough 371 so that the buckling slice 37 and the inserting slices 38 are coupled with the buckling recess 14 and the grooves 143, respectively. A peripheral side 322 of the indention area 32 has two opposite portions respectively formed with two open first slots 33, which are parallel with and spaced from each other to form a first filling lump 35 therebetween, and two open second slots 34 which are parallel with and spaced from each other to form a second filling lump 36 therebetween. The first slots 33 and the second slots 34 substantially and respectively face each other and are adapted for receiving the third stopping ribs 1311, 1321 and the fourth stopping ribs 1313, 1323. The first filling lump 35 and the second filling lump 36 are both rectangular shape, with inner sides shaped to show arc shape conforming to the side 322 of the indention area 32. The first filling lump 35 is received in the chamber 133. The second filling lump 36 is protruded beyond the engaging side 311 with a predetermined distance for inserting into the receiving trough 134. A lower portion of the engaging side 311 is protruded perpendicularly and outwardly to form two hooks 39, with originated ends thereof opposite to each other, for buckling with the hooking grooves 15.

As described above, the cap 30 is fixed to the insulating housing 10 by means of the buckling slice 37 buckled with the buckled recess 14, and the hooks 39 locked with the hooking grooves 15. The first and second filling lumps 35, 36 are respectively received in the chamber 133 and the receiving trough 134. The third stopping ribs 1311, 1321 and the fourth stopping ribs 1313, 1323 are inserted into the corresponding the first and second slots 33, 34. The first and second stopping ribs 1312, 1322 abut against the side 322 of the indention area 32. Such engagement in form with protrusion and recess is tight and reliable to seal the inner end of the passageway 111, preventing the water from permeating an electronic device where the water-proof connector 100 is mounted, through the passageway 111.

The foregoing description of the present invention has been presented for the purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A water-proof connector adapted for connecting with a mating plug, comprising:

an insulating housing having a base, the base having a passageway passing through a first end thereof from which the mating plug is inserted into the passageway and a second end thereof opposite to the first end, the second end having a first stopping rib and a second stopping rib protruded outwards from an upper portion and a lower portion of an edge of the passageway, the first stopping rib spaced from the second stopping rib, two free ends of each of the first and second stopping ribs extended opposite to each other to form a third stopping rib and a fourth stopping rib; and a cap covered to the second end of the insulating housing having a covering plate, the covering plate having an indention area at an engaging side thereof, a peripheral side of the indention area which encloses and abuts against the first stopping rib and the second stopping rib, having two opposite portions formed with two spaced open first slots and two spaced open second slots, respectively, for engaging with the third stopping ribs and the fourth stopping ribs.

2. The water-proof connector as claimed in claim 1, wherein an area between the fourth stopping ribs is formed with a receiving trough, communicating with the passageway, a filling lump between the second slots is protruded beyond the engaging side of the cap with a predetermined distance for inserting into the receiving trough.

3. The water-proof connector as claimed in claim 1, wherein the first slots and the second slots substantially and respectively face each other.

4. The water-proof connector as claimed in claim 1, wherein the first slots are substantially parallel to each other.

5. The water-proof connector as claimed in claim 1, wherein the second slots are substantially parallel to each other.

6. The water-proof connector as claimed in claim 1, wherein the base has a buckling recess at a top surface thereof and passing through the second end, a bottom of the buckling recess has a buckling lump, a portion of the cap upon the indention area is extended perpendicularly to form a buckling slice, the buckling slice has a trough at a bottom thereof for buckling with the buckling lump when the buckling slice is coupled with the buckling recess.

7. The water-proof connector as claimed in claim 6, wherein the bottom of the buckling recess has two grooves at two sides thereof, each of the grooves passes through the second end and reaches two contiguous sides of the buckling recess, for receiving two inserting slices which depend from two opposite sides of the buckling slice.

8. The water-proof connector as claimed in claim 6, wherein the buckling lump has an inclining surface adjacent to the second end, a side wall of the trough away from the covering plate is formed with an inclining surface for buckling with the buckling lump conveniently.

9. The water-proof connector as claimed in claim 1, wherein a portion of the engaging side of the cap beneath the indention area is protruded outwards to form two spaced hooks, with originated ends opposite to each other, for locking with hooking grooves formed at a lower portion of the second end.

* * * * *